US012287182B2

(12) United States Patent
Eitschberger

(10) Patent No.: US 12,287,182 B2
(45) Date of Patent: Apr. 29, 2025

(54) INITIATOR HEAD WITH CIRCUIT BOARD

(71) Applicant: DynaEnergetics Europe GmbH, Troisdorf (DE)

(72) Inventor: Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 18/190,441

(22) Filed: Mar. 27, 2023

(65) Prior Publication Data

US 2024/0191979 A1 Jun. 13, 2024

Related U.S. Application Data

(60) Provisional application No. 63/386,984, filed on Dec. 12, 2022.

(51) Int. Cl.

| | |
|---|---|
| ***F42B 3/103*** | (2006.01) |
| ***E21B 43/1185*** | (2006.01) |
| ***F42B 3/195*** | (2006.01) |
| ***F42B 3/198*** | (2006.01) |

(52) U.S. Cl.

CPC ..... *F42B 3/103* (2013.01); *E21B 43/1185* (2013.01); *F42B 3/195* (2013.01); *F42B 3/198* (2013.01)

(58) Field of Classification Search

CPC .. F42B 3/10; F42B 3/103; F42B 3/195; F42B 3/198; E21B 43/1185

USPC ..... 102/202.14

See application file for complete search history.

(56) References Cited

U.S. PATENT DOCUMENTS

| | | | |
|---|---|---|---|
| 4,291,623 | A | 9/1981 | Robinson |
| 6,079,332 | A | 6/2000 | Marshall et al. |
| 9,879,951 | B2 | 1/2018 | Biggs et al. |
| 10,267,604 | B1 | 4/2019 | Morales et al. |
| 10,281,249 | B2 | 5/2019 | Rueda et al. |
| 10,400,558 | B1 | 9/2019 | Shahinpour et al. |
| 10,480,920 | B2 | 11/2019 | Lucas et al. |
| 10,669,822 | B2 | 6/2020 | Eitschberger |
| D903,064 | S | 11/2020 | Mulhern et al. |
| 10,844,697 | B2 | 11/2020 | Preiss et al. |
| 11,307,011 | B2 * | 4/2022 | Eitschberger ..... H02H 9/005 |

(Continued)

FOREIGN PATENT DOCUMENTS

| | | |
|---|---|---|
| CN | 209166247 U | 7/2019 |
| CN | 109373835 B | 4/2021 |

(Continued)

OTHER PUBLICATIONS

European Searching Authority; International Search Report and Written Opinion issued in PCT/EP2023/083824 dated Mar. 25, 2024; 15 pages.

(Continued)

*Primary Examiner* — James S Bergin

(74) *Attorney, Agent, or Firm* — Womble Bond Dickinson (US) LLP

(57) ABSTRACT

An initiator head includes a housing piece defining an interior chamber, a circuit board supported in the interior chamber, a line-in terminal coupled to the circuit board, and insulating material filling the interior chamber and covering a top surface of the circuit board for absorbing shocks or vibrations and electrically insulating electronics of the circuit board.

3 Claims, 14 Drawing Sheets

(56) References Cited

U.S. PATENT DOCUMENTS

| | | | | |
|---|---|---|---|---|
| 11,313,653 | B2 * | 4/2022 | Kash | E21B 43/1185 |
| 11,339,614 | B2 | 5/2022 | Mulhern et al. | |
| 11,377,935 | B2 | 7/2022 | Austin et al. | |
| 11,808,093 | B2 * | 11/2023 | Eitschberger | E21B 43/117 |
| 11,946,728 | B2 * | 4/2024 | Eitschberger | H05K 5/0247 |
| 2003/0221577 | A1 | 12/2003 | Walsh et al. | |
| 2015/0345922 | A1 | 12/2015 | Lanclos et al. | |
| 2020/0400417 | A1 | 12/2020 | Eitschberger et al. | |
| 2021/0223007 | A1 | 7/2021 | Kash et al. | |
| 2022/0251931 | A1 | 8/2022 | Pearson | |
| 2022/0307330 | A1 | 9/2022 | Eitschberger et al. | |

FOREIGN PATENT DOCUMENTS

| | | | |
|---|---|---|---|
| CN | 217844937 | U | 11/2022 |
| EP | 1257440 | B1 | 11/2006 |
| WO | 2015028204 | A2 | 3/2015 |
| WO | 2018129350 | A1 | 7/2018 |

OTHER PUBLICATIONS

Dyno Nobel; Driftshot Electronic Initiation for Precise & Rapid Underground Development; Dec. 30, 2022; 14 pages; https://www.dynonobel.com/practical-innovations/popular-products/eis.

* cited by examiner

INITIATOR HEAD WITH CIRCUIT BOARD

CROSS-REFERENCE TO RELATED APPLICATION

This application claims the benefit of and priority to U.S. Provisional Patent Application No. 63/386,984 filed Dec. 12, 2022, the entire contents of which being incorporated by reference herein.

BACKGROUND OF THE DISCLOSURE

Hydrocarbons, such as fossil fuels and natural gas, are extracted from underground wellbores extending deeply below the surface using complex machinery and explosive devices. Once the wellbore is established by placement of cases after drilling, a perforating gun assembly, or train or string of multiple perforating gun assemblies, is lowered into the wellbore and positioned adjacent one or more hydrocarbon reservoirs in underground formations. The perforating gun may have explosive charges which are ignited to create holes in the casing and to blast through the formation so that the hydrocarbons can flow through the casing. Once the perforating gun(s) is properly positioned, a surface signal actuates an ignition of a fuse, which in turn initiates a detonating cord, which detonates the shaped charges to penetrate/perforate the casing and thereby allow formation fluids to flow through the perforations thus formed and into a production string. The surface signal may travel from the surface along electrical wires that run from the surface to one or more initiators, such as ignitors or detonators positioned within the perforating gun assembly.

Assembly of a perforating gun requires assembly of multiple parts, which may include at least the following components: a housing or outer gun barrel within which is positioned an electrical wire for communicating from the surface to initiate ignition, of an initiator and/or a detonator, a detonating cord, one or more charges and, where necessary, one or more boosters. Assembly may include threaded insertion of one component into another by screwing or twisting the components into place, optionally by use of a tandem adapter. Since the electrical wire must extend through much of the perforating gun assembly, the wire may become easily twisted and crimped during assembly. In addition, when a wired detonator is used it must be manually connected to the electrical wire, which may lead to multiple problems. Due to the rotating assembly of parts, the wires can become torn, twisted and/or crimped/nicked, the wires may be inadvertently disconnected, or even mis-connected in error during assembly. This may lead to costly delays in extracting the hydrocarbons. Additionally, there is a significant safety risk associated with physically and manually wiring live explosives.

Accordingly, there may be a need for an initiator that would allow for reliable detonation of perforating guns without requiring physically and manually wiring live explosives.

Additionally, in certain applications, hydraulic fracturing may produce optimal results when perforations are oriented in the direction of maximum principle stress or the preferred fracture plane (PFP). Perforations oriented in the direction of the PFP create stable perforation tunnels and transverse fractures (perpendicular to the wellbore) that begin at the wellbore face and extend far into the formation. However, if fractures are not oriented in the direction of maximum stress, tortuous, non-transverse fractures may result, creating a complex near-wellbore flow path that can affect the connectivity of the fracture network, increase the chance of premature screen-out, and impede hydrocarbon flow. Accordingly, there may be a need for equipment that can allow for orientation verification of the perforating guns to ensure that perforations are formed in the preferred fracture plane.

BRIEF DESCRIPTION

An exemplary embodiment of an initiator head includes a housing, a circuit board, and a line-in terminal. The housing includes a first housing piece defining an interior chamber, and a second housing piece covering the interior chamber. The circuit board is supported in the interior chamber, and the line-in terminal is coupled to the circuit board. The housing defines a hole therethrough in fluid communication with the interior chamber.

Another exemplary embodiment of an initiator head includes a first housing piece defining an interior chamber, a circuit board supported in the interior chamber, a line-in terminal coupled to the circuit board, and a second housing piece filling the interior chamber and covering a top surface of the circuit board.

An exemplary method of manufacturing an initiator head includes injection molding a first housing piece and filling an interior chamber of the first housing piece with an insulating material thereby covering electronics of a circuit board with the insulating material. The circuit board may be positioned within the interior chamber of the first housing piece.

Another exemplary embodiment of an initiator head includes a housing, a circuit board, insulating material, and a line-in terminal coupled to the circuit board. The housing includes a first housing piece defining an interior chamber, and a second housing piece covering the interior chamber. The circuit board is supported in the interior chamber and the insulating material is provided in the interior chamber and at least partially covers the circuit board.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
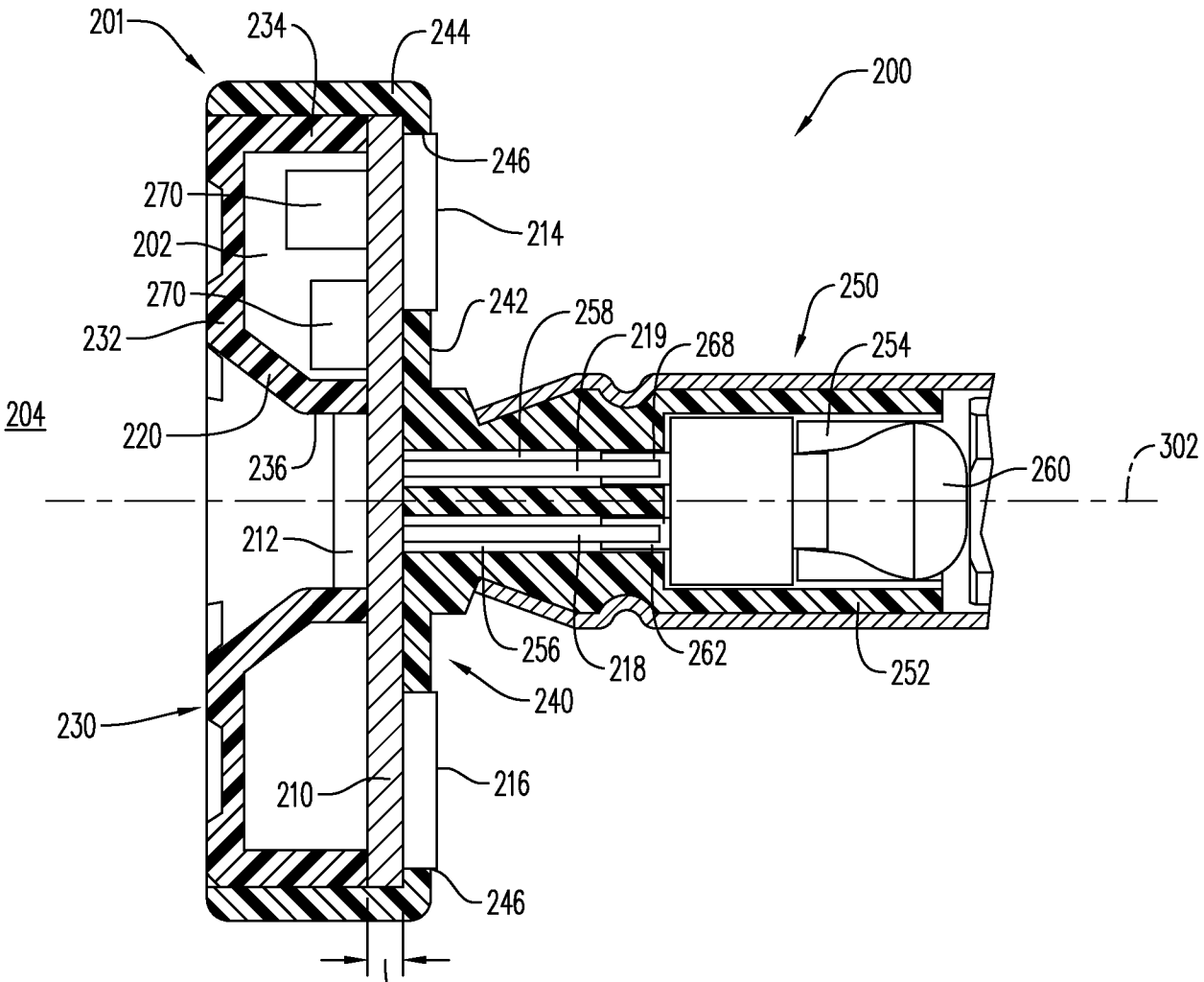
FIG. 1 is a cross section view of an initiator head according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

FIGS. 1-7 show an exemplary embodiment of an initiator head 200. The initiator head may include a housing 201, a circuit board 210, a line-in terminal 212, a line-out terminal 214, a ground terminal 216, a stem 250, and a fuse 260.

As seen in FIG. 1, the housing 201 may extend in an axial direction 302 and may define an interior space 202. The housing 201 may be formed of an insulating material, and may be formed by molding, 3D-printing, additive manufacturing, subtractive manufacturing, or any other suitable method. For example, in an exemplary embodiment, the housing 201 may be formed of a non-conductive plastic material such as polyamide. The housing 201 may include a first housing piece 230 and a second housing piece 240 engaged together. Alternatively, the housing 201 may be an integral or monolithic piece molded or additively manufactured around the circuit board 210.

Figure 4:
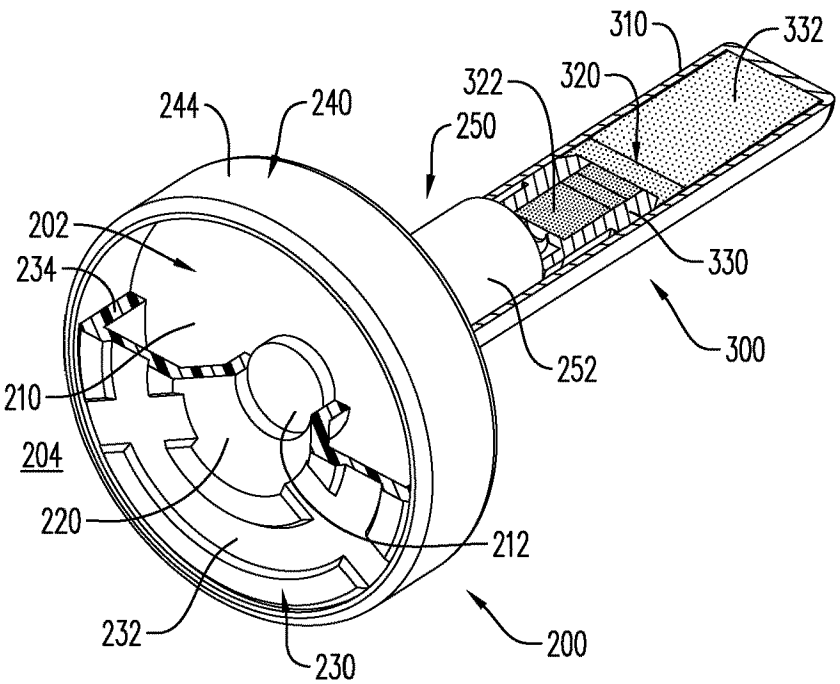
FIG. 4 is a partial, cross section view of an initiator according to an exemplary embodiment, showing a cutaway view of a head and a cross-section of an initiator shell.

FIG. 1 further shows that an exemplary embodiment of the first housing piece 230 may include a first plate 232. A thickness direction of the first plate 232 may be substantially parallel to the axial direction 302. As further seen in FIGS. 1-2, an exemplary embodiment of the first plate 232 may be shaped as an annulus having a substantially circular periphery and a substantially circular through hole 236. The through hole 236 may be structured to expose the line-in terminal 212 to an exterior 204 of the housing 201. The first plate 232 may further include a sloped wall 220 sloping from the first plate in the axial direction 302 toward the circuit board 210. The sloped wall 220 may help to guide a contact pin to contact with the line-in terminal 212. The first housing piece 230 may further include a first outer peripheral wall 234 extending from the first plate 232 in the axial direction 302. FIG. 1 and FIG. 4 show an exemplary embodiment in which the first outer peripheral wall 234 extends from an outer periphery of the first plate 232.

Figure 3:
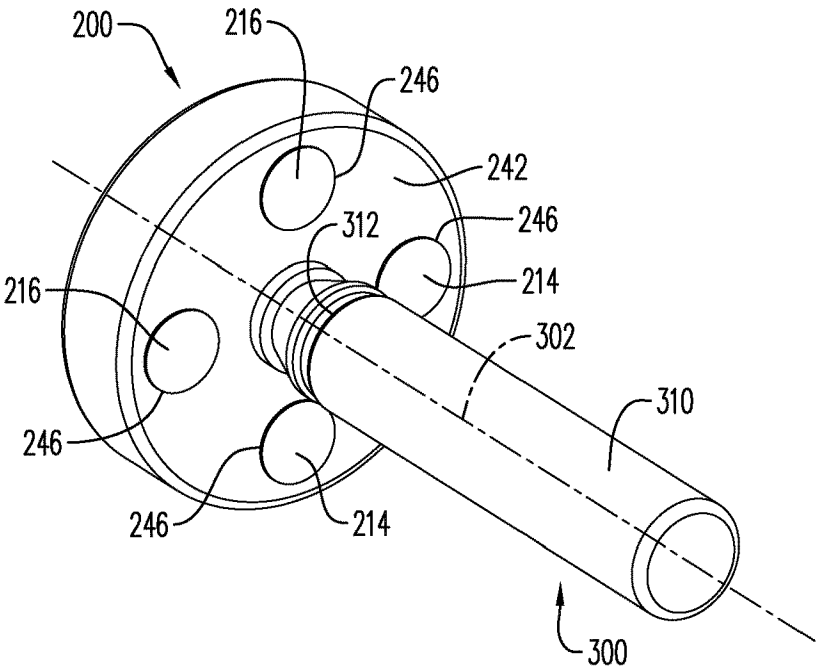
FIG. 3 is a perspective view of an initiator according to an exemplary embodiment.
Figure 2:
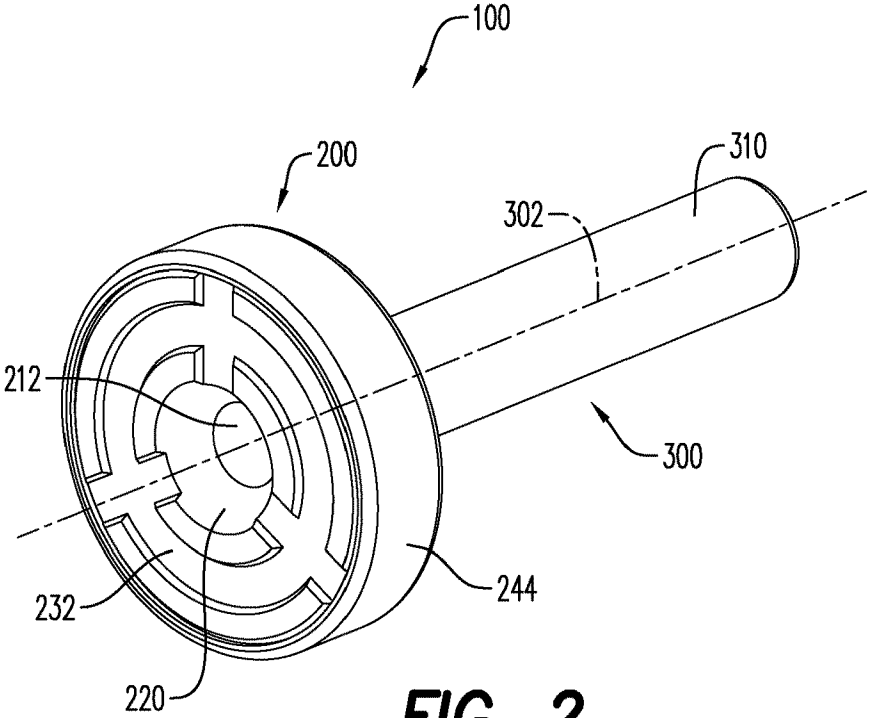
FIG. 2 is a perspective view of an initiator according to an exemplary embodiment.
Figure 5:
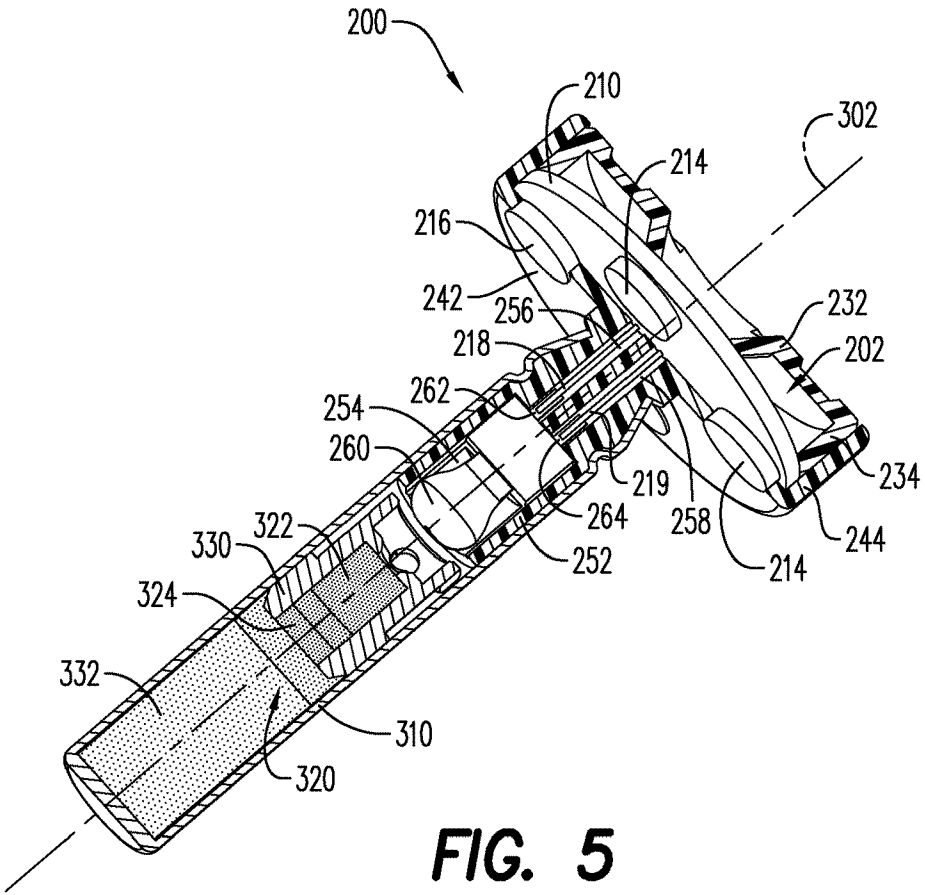
FIG. 5 is a partial cross section view of an initiator according to an exemplary embodiment, showing a cutaway view of a head and a cross-section of an initiator shell.

FIG. 1 further shows that an exemplary embodiment of the second housing piece 240 may include a second plate 242. A thickness direction of the second plate 242 may be substantially parallel to the axial direction 302. As further seen in FIG. 3, an exemplary embodiment of the second plate 242 may be substantially circular in shape. The second plate 242 may further include through holes 246 structured to expose the line-out terminal 214 and the ground terminal 216 to an exterior 204 of the housing 201. The second housing piece 240 may further include a second outer peripheral wall 244 extending from the second plate 242 in the axial direction 302. FIG. 1 and FIG. 3 show an exemplary embodiment in which the second outer peripheral wall 244 extends from an outer periphery of the second plate 242.

As further seen in FIG. 1, the first outer peripheral wall 234 and the second outer peripheral wall 244 may overlap in the axial direction, such that the interior space 202 is formed between the first plate 232 and the second plate 242 in the axial direction. In other words, the interior space 202 may be bounded by the first housing piece 230 and the second housing piece 240. In an exemplary embodiment, a first housing piece radius of the first housing piece 230 may be smaller than a second housing piece radius of the second housing piece 240. Thus, the first housing piece 230 may be received within the second housing piece 240 with the first outer peripheral wall 234 being provided between the first plate 232 and the second plate 242 in the axial direction 302. Alternatively, the first housing piece radius may be larger than the second housing piece radius, and the second housing piece 240 may be received within the first housing piece 230, with the second peripheral wall 234 being provided between the first plate 232 and the second plate 242 in the axial direction 302.

The first housing piece 230 and the second housing piece 240 may be dimensioned such that the first housing piece 230 and the second housing piece 240 fit snugly together so as not to separate under normal operating conditions. Alternatively, the first housing piece 230 and the second housing piece 240 may be provided with a coupling mechanism such as hook or protrusion and a complementary recess, so that the first housing piece 230 and the second housing piece 240 may snap together. Alternatively, the first outer peripheral wall 234 and the second outer peripheral wall 244 may be complementarily threaded so that the first housing piece 230 and the second housing piece 240 may screw together. Alternatively, the first housing piece 230 and the second housing piece 240 may be bonded together with adhesive.

FIG. 1 further shows an exemplary embodiment of a circuit board 210. A thickness direction 211 of the circuit board 210 may be substantially parallel with the axial direction 302. As explained in further detail herein, orienting the thickness direction 211 substantially parallel with the axial direction 302 allows room for larger firing capacitors and/or surface mounted components 270 to be mounted on the circuit board 210.

In an exemplary embodiment, the line-in terminal 212, the line-out terminal 214, the ground terminal 216, and the fuse 260 may be in electrical communication with the circuit board 210. The line-in terminal 212 may be provided on a first side of the circuit board 210 in the axial direction, and thereby the line-in terminal 212 may be provided on a first side of the housing 201 in the axial direction (i.e., to the left in FIG. 1). The line-out terminal 214 and the ground terminal 216 may be provided on a second side of the circuit board 210 in the axial direction opposite to the first side (i.e., to the right in FIG. 1). The line-out terminal 214 may be configured to output a signal received by the line-in terminal 212, either directly or in response to processing by the circuit board 210, as described in detail herein, by being in electrical communication with either the line-in terminal 212 or the circuit board 210.

FIG. 3 shows an exemplary embodiment in which a plurality of line-out terminals 214 and a plurality of ground terminals 216 are provided. The plurality of line-out terminals 214 and the plurality of ground terminals 216 provide a layer of redundancy to help ensure sufficient connection of the initiator head 200 to external electrical components, as explained in detail herein. Each line-out terminal 214 of the plurality of line-out terminals 214 may be directly connected to each other within the housing 201 or on the circuit board 210. In other words, if one line-out terminal 214 is in electrical communication with the circuit board 210, then each line-out terminal 214 of the plurality of line-out terminals 214 may be in electrical communication with the circuit board 210. Similarly, if one line-out terminal 214 becomes in electrical communication with the line-in terminal 212, then each line-out terminal 214 of the plurality of line-out terminals may be in electrical communication with the line-in terminal 212. Similarly, if one ground terminal 216 is in electrical communication with the circuit board 210, then each ground terminal 216 of the plurality of ground terminals 216 may be in electrical communication with the circuit board 210.

Figure 7:
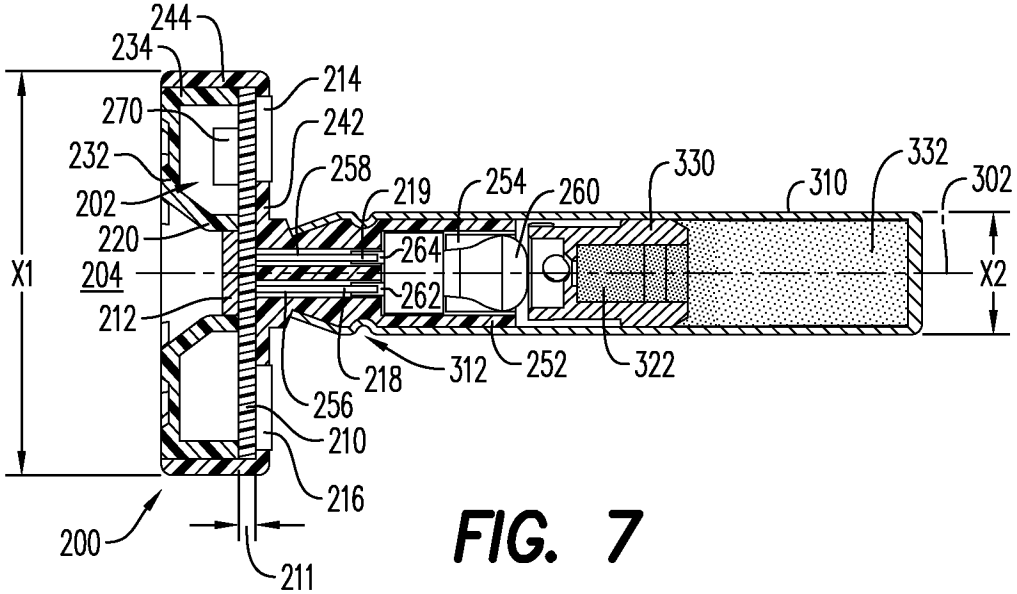
FIG. 7 is a cross section view of an initiator according to an exemplary embodiment.

As further seen in FIG. 1 and FIG. 7, the circuit board 210 may be a printed circuit board and/or may include one or more surface mounted components 270. The arrangement of the circuit board 210 and the shape of the initiator head 200 may provide sufficient space in the interior space 202 to accommodate a variety of surface mounted components 270. In an exemplary embodiment, the surface mounted component 270 of the circuit board 210 may be an integrated circuit (IC) with a dedicated function, a programmable IC, or a microprocessor IC. The circuit board 210 may be configured to activate the fuse 260 in response to a control signal received at the line-in terminal 212. For example, a user may send a firing signal via a firing panel. The firing signal may be received at the line-in terminal 212, and the circuit board 210, through ICs provided on the circuit board 210, may process the firing signal and activate the fuse 260. Additionally, the circuit board 210 may include a switch circuit configured to establish electrical communication between the line-out terminal 214 and the line-in terminal 212 in response to a predetermined switch signal. The line-out terminal 214 may be in electrical communication with subsequent initiator heads 200 provided downstream in a string of connected perforating guns, thereby allowing a user to send switch signals to toggle which initiator head is active to receive a firing command.

In an exemplary embodiment, one of the surface mounted components 270 may be one selected from a group consisting of a temperature sensor, an orientation sensor, a safety circuit, and a capacitor. Readings from one of these components may be used by a microprocessor on circuit board 210 to determine when it is appropriate to activate the fuse 260. The temperature sensor may be configured to measure temperature of the wellbore environment and provide a signal corresponding to the temperature to the circuit board 210. The orientation sensor may include, but is not limited to, an accelerometer, a gyroscope, and/or a magnetometer. The orientation sensor may be configured to determine an orientation of the initiator head 200 within the wellbore, which, if the orientation of the initiator head is fixed relative to a charge holder, can be used to determine an orientation of the charge(s) in the perforating gun. In an exemplary embodiment, the orientation sensor may determine an orientation of the initiator head 200 relative to gravity. Alternatively, the orientation sensor may determine an orientation of the initiator head relative an ambient magnetic field. The safety circuit may provide additional safety precautions to prevent unintentional activation of the initiator 100. The capacitor may be used to store a voltage to activate the fuse 260. The size of the interior space 202 may allow for a larger capacity capacitor to be used. This allows a larger discharge voltage for activating the fuse 260, which may help to ensure more reliable activation of the fuse 260.

FIG. 1 and FIGS. 4-7 further show an exemplary embodiment of the stem 250. The stem 250 may extend in the axial direction 302 from the housing 201. In an exemplary embodiment, the stem 250 may be formed of the same material as the second housing piece 240 and may be integrally and/or monolithically formed with the second plate 242. Alternatively, the stem may be formed as a separate piece and mechanically connected to the second housing piece via clips or mated structures such as protrusions and recesses, or adhesively connected using an adhesive.

As seen in FIG. 1, the stem 250 may include a stem outer peripheral wall 252. The stem outer peripheral wall 252 may define a stem cavity 254 provided radially inward from the stem outer peripheral wall 252. A first discharge channel 256 and a second discharge channel 258 may connect the stem cavity 254 and the interior space 202 of the housing 201. The first discharge channel 256 may accommodate therein a first discharge terminal 218 in electrical communication with the circuit board 210. In other words, the first discharge terminal 218 may extend from the circuit board 210 into the first discharge channel 256. Similarly, the second discharge channel 256 may accommodate therein a second discharge terminal 219 in electrical communication with the circuit board 210. In other words, the second discharge terminal 219 may extend from the circuit board 210 into the second discharge channel 258.

FIG. 1 further shows that, in an exemplary embodiment, the fuse 260 may be provided within the stem cavity 254. A first end of a first fuse terminal 262 may be in electrical communication with the first discharge terminal 218 within the first discharge channel 256, and a second end of the first fuse terminal may be proximate to the fuse 260. A first end of a second fuse terminal 264 may be in electrical communication with the second discharge terminal 219 within the second discharge channel 258, and a second end of the second fuse terminal 264 may be proximate to the fuse 260 and the second end of the first fuse terminal 262. The circuit board 210 may be configured to activate the fuse 260 in response to a control signal by discharging a stored voltage across the first fuse terminal 262 and the second fuse terminal 264. The store voltage may be stored in a capacitor in electrical communication with the circuit board 210. In an exemplary embodiment, the capacitor may be one of the surface mounted components 270 provided on the circuit board 210. The proximity of the second end of the first fuse terminal 262 and the second end of the second fuse terminal 264 may allow for the generation of a spark when the stored voltage is discharged, thereby activating the fuse 260. In an exemplary embodiment, activating the fuse 260 may include igniting or detonating the fuse 260.

Figure 6:
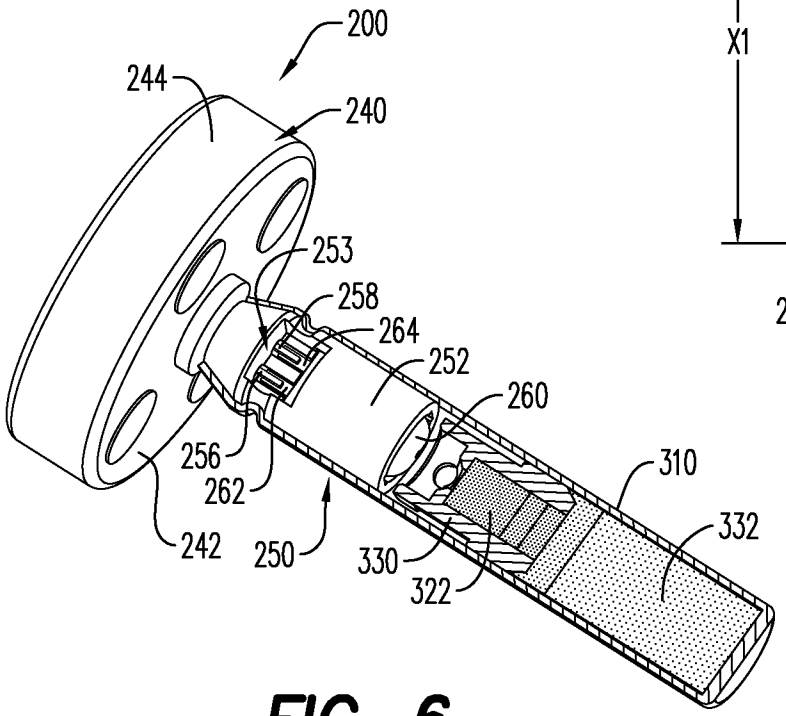
FIG. 6 is a partial, cross section view of an initiator, illustrating contents of an initiator shell according to an exemplary embodiment.

As seen in FIG. 6, an exemplary embodiment of the stem 250 may include a window 253 cut through the stem outer peripheral wall 252. The window 253 may allow access for a user to connect the first discharge terminal 218 to the first fuse terminal 262 and the second discharge terminal 219 to the second fuse terminal 264, such as by soldering, during assembly of the initiator head 200.

Figure 14:
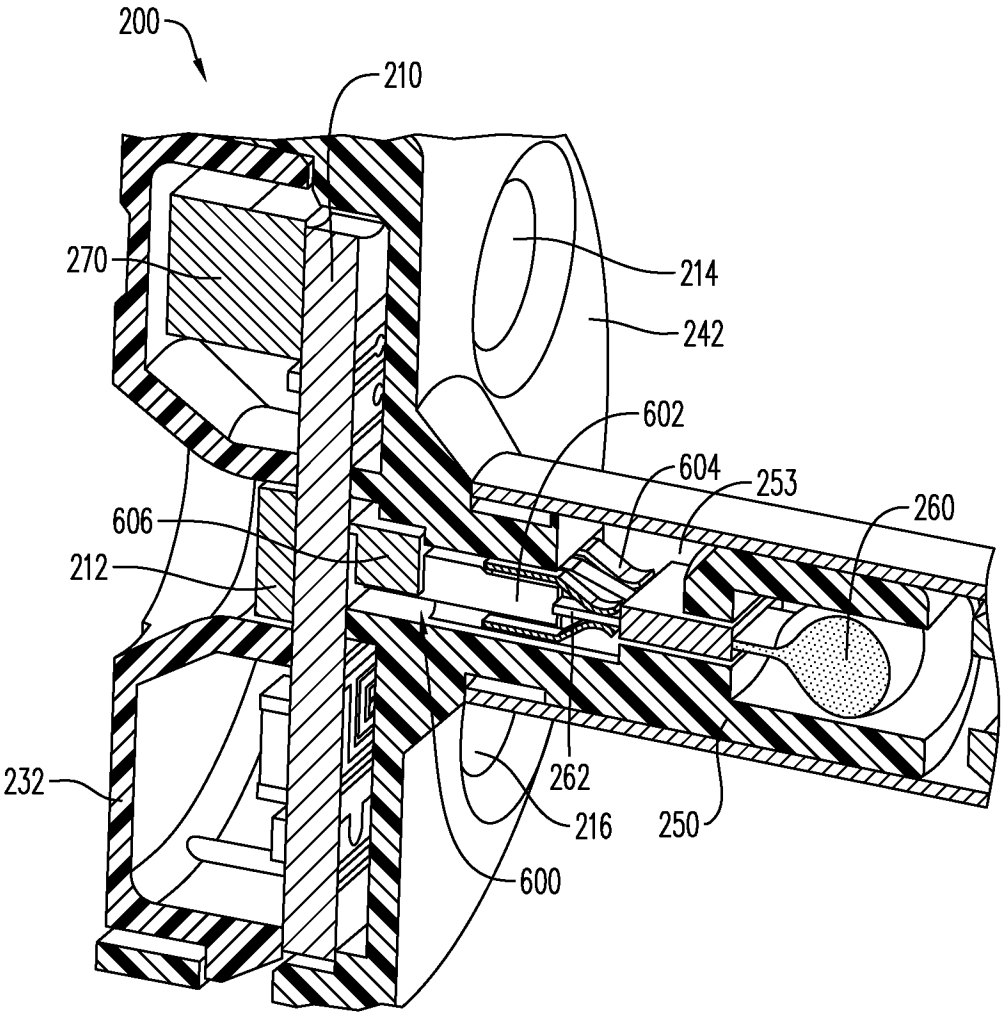
FIG. 14 is a cutaway perspective view of an initiator head according to an exemplary embodiment.

FIGS. 14-19 show exemplary embodiments in which the circuit board 210 is in electrical communication with the fuse 260 via direct physical contact, so as to streamline the manufacturing process by eliminating soldering between the circuit board 210 and the fuse 260. For example, FIG. 14 shows an exemplary embodiment in which the circuit board 210 is in electrical communication with the fuse 260 via a fuse connector assembly 600. The fuse connector assembly 600 may include a first discharge connector 602 configured to receive and make direct electrical contact with the first fuse terminal 262 and a second discharge connector 604 configured to receive and make direct electrical contact with the second fuse terminal 264 (not shown in FIG. 14).

The fuse connector assembly 600 may include a mounting block 606, the first discharge connector 602 extending through the mounting block 606, and the second discharge connector 604 extending through the mounting block 606. The mounting block 606 may be formed of an insulating material and may facilitate connection and/or fastening of the fuse connector assembly 600 to the circuit board 210. Further, the mounting block 606 may provide mechanical strength and support for the fuse connector assembly 600. When the fuse connector assembly 600 is connected to the circuit board 210, the first discharge connector 602 and the second discharge connector 604 may extend from the circuit board 210 into the stem 250.

Figure 15:
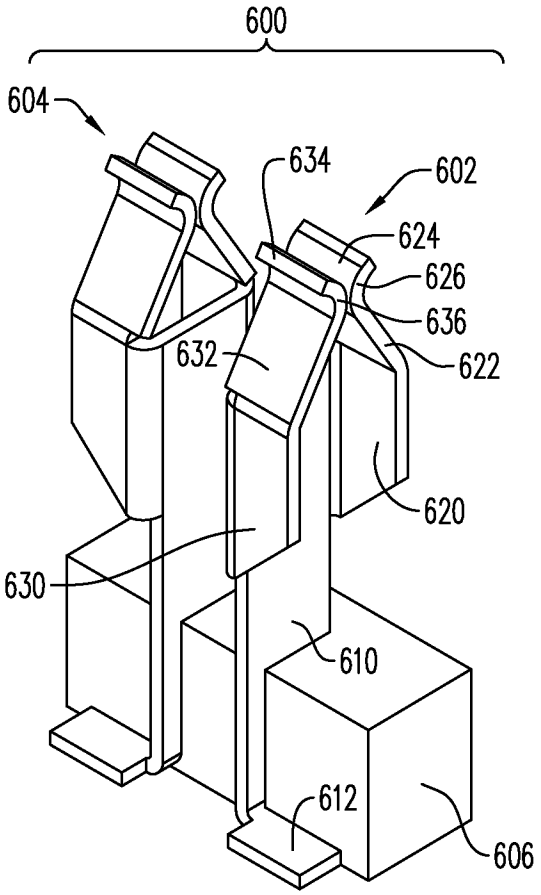
FIG. 15 is a perspective view of a fuse connector assembly according to an exemplary embodiment.

FIG. 15 further shows an exemplary embodiment of the first discharge connector 602. For simplicity, only the first discharge connector 602 is described in detail herein; it will be understood from FIG. 15 that the second discharge connector 604 may be substantially similar to the first discharge connector 602 in terms of structure. The first discharge connector 602 may be formed of an electrically conductive material. The first discharge connector 602 may include a first body portion 610, and a first board connector terminal 612 may be provided at a first end of the first body portion 610. The first board connector terminal 612 may connect to the circuit board 210.

The first discharge connector 602 may further include a first base portion 620 and a second base portion 630 extending from the first body portion 610 at a second end of the first body portion 610. The first discharge connector 602 may further include a first arm portion 622 extending from the first base portion 620 and a second arm portion 632 extending from the second base portion 630. The first arm portion 622 may be bent or inclined in a direction toward the second arm portion 632. Similarly, the second arm portion 632 may be bent or inclined in a direction toward the first arm portion 622. The first discharge connector 602 may further include a first tip portion 624 at an end of the first arm portion 622 and a second tip portion 634 at an end of the second arm portion 632. The first tip portion 624 may be bent or inclined in a direction away from the second tip portion 634. Similarly, the second tip portion 634 may be bent or inclined in a direction away from the first tip portion 624.

A first contact portion 626 may be formed between the first arm portion 622 and the first tip portion 624, and a second contact portion 636 may be formed between the second arm portion 632 and the second tip portion 634. The first contact portion 626 may be resiliently biased toward the second contact portion 636 based on the connection between the first base portion 620 and the first arm portion 622. Similarly, the second contact portion 636 may be resiliently biased toward the first contact portion 626 based on the connection between the second base portion 630 and the second arm portion 632. The first contact portion 626 may be in contact with the second contact portion 636. Alternatively, there may be a gap between the first contact portion 626 and the second contact portion 636. In an exemplary embodiment, a size of the gap may be less than a thickness of the first fuse terminal 262.

The first discharge connector 602 may be configured to receive, and make electrical contact with, the first fuse terminal 262. Similarly, the second discharge connector 604 may be configured to receive, and make electrical contact with, the second fuse terminal 264. For example, during assembly of the initiator head 200, the circuit board 210 and the fuse 260 may be pushed together in the axial direction 302, thereby bringing the first fuse terminal 262 into contact with the first tip portion 624 and the second tip portion 634. Further relative motion between the fuse 260 and the circuit board 210 may cause the first fuse terminal 262 to deflect the first tip portion 624 and the second tip portion 634 away from each other. The first fuse terminal 262 may then be in contact with the first contact portion 626 and the second contact portion 636, i.e., sandwiched between the first contact portion 626 and the second contact portion 636. The resilient bias of the first contact portion 626 and the second contact portion 636 may help to maintain contact, and thus electrical communication, between the first contact portion 626, the second contact portion 636, and the first fuse terminal 262. It will be understood that contact between the second discharge connector 604 and the second fuse terminal 264 may be achieved in a similar way. The window 253 may allow for visual confirmation of the connection between the first discharge connector 602 and the first fuse terminal 262 and between the second discharge connector 604 and the second fuse terminal 264.

Figure 16:
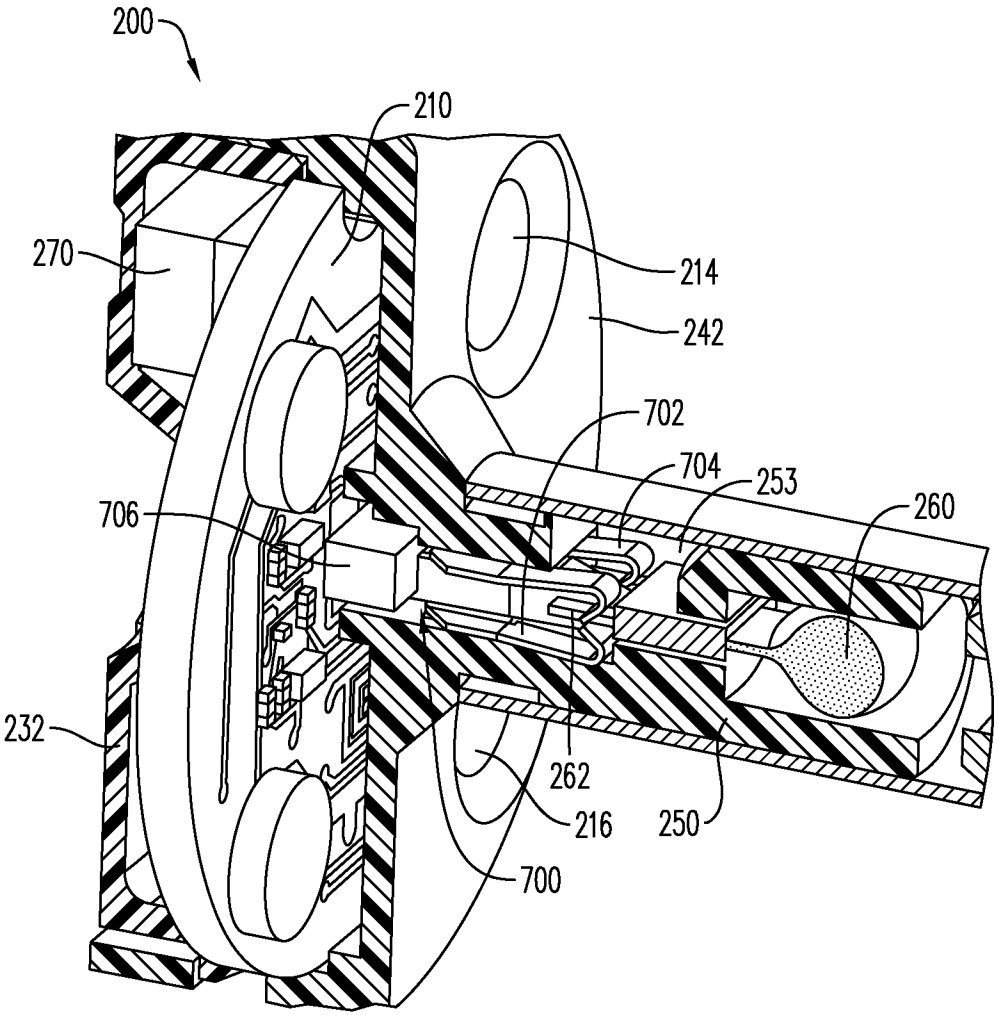
FIG. 16 is a cutaway perspective view of an initiator head according to an exemplary embodiment.

FIG. 16 shows an exemplary embodiment in which the circuit board 210 is in electrical communication with the fuse 260 via a fuse connector assembly 700. The fuse connector assembly 700 may include a first discharge connector 702 configured to receive and make direct electrical contact with the first fuse terminal 262 and a second discharge connector 704 configured to receive and make direct electrical contact with the second fuse terminal 264 (not shown in FIG. 16).

The fuse connector assembly 700 may include a mounting block 706, the first discharge connector 702 extending through the mounting block 706, and the second discharge connector 704 extending through the mounting block 706. The mounting block 706 may be formed of an insulating material and may facilitate connection and/or fastening of the fuse connector assembly 700 to the circuit board 210. Further, the mounting block 706 may provide mechanical strength and support for the fuse connector assembly 700. When the fuse connector assembly 700 is connected to the circuit board 210, the first discharge connector 702 and the second discharge connector 704 may extend from the circuit board 210 into the stem 250.

Figure 17:
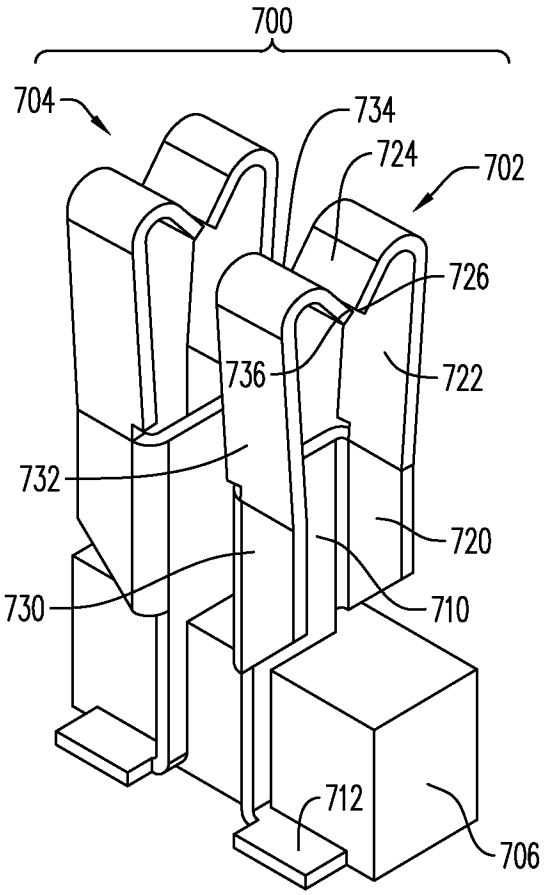
FIG. 17 is a perspective view of a fuse connector assembly according to an exemplary embodiment.

FIG. 17 further shows an exemplary embodiment of the first discharge connector 702. For simplicity, only the first discharge connector 702 is described in detail herein; it will be understood from FIG. 17 that the second discharge connector 704 may be substantially similar to the first discharge connector 702 in terms of structure. The first discharge connector 702 may be formed of an electrically conductive material. The first discharge connector 702 may include a first body portion 710, and a first board connector terminal 712 may be provided at a first end of the first body portion 710. The first board connector terminal 712 may connect to the circuit board 210.

The first discharge connector 702 may further include a first base portion 720 and a second base portion 730 extending from the first body portion 710 at a second end of the first body portion 710. The first discharge connector 702 may further include a first arm portion 722 extending from the first base portion 720 and a second arm portion 732 extending from the second base portion 730. The first arm portion 722 may be bent or inclined in a direction away from the second arm portion 732. Similarly, the second arm portion 732 may be bent or inclined in a direction away from the first arm portion 722. The first discharge connector 702 may further include a first tip portion 724 at an end of the first arm portion 722 and a second tip portion 734 at an end of the second arm portion 732. The first tip portion 724 may be bent or inclined in a direction toward the second tip portion 734 and back toward the first body portion 710. Similarly, the second tip portion 734 may be bent or inclined in a direction toward the first tip portion 724 and back toward the first body portion 710.

A first contact portion 726 may be formed at an end of the first tip portion 724, and a second contact portion 736 may be formed at an end of the second tip portion 734. The first contact portion 726 may be resiliently biased toward the second contact portion 736 based on the connection between the first base portion 720 and the first arm portion 722. Similarly, the second contact portion 736 may be resiliently biased toward the first contact portion 726 based on the connection between the second base portion 730 and the second arm portion 732. The first contact portion 726 may be in contact with the second contact portion 736. Alternatively, there may be a gap between the first contact portion 726 and the second contact portion 736. In an exemplary embodiment, a size of the gap may be less than a thickness of the first fuse terminal 262.

The first discharge connector 702 may be configured to receive, and make electrical contact with, the first fuse terminal 262. Similarly, the second discharge connector 704 may be configured to receive, and make electrical contact with, the second fuse terminal 264. For example, during assembly of the initiator head 200, the circuit board 210 and the fuse 260 may be pushed together in the axial direction 302, thereby bringing the first fuse terminal 262 into contact with the first tip portion 724 and the second tip portion 734. Further relative motion between the fuse 260 and the circuit board 210 may cause the first fuse terminal 262 to deflect the first tip portion 724 and the second tip portion 734 away from each other. The first fuse terminal 262 may then be in contact with the first contact portion 726 and the second contact portion 736, i.e., sandwiched between the first contact portion 726 and the second contact portion 736. The resilient bias of the first contact portion 726 and the second contact portion 736 may help to maintain contact, and thus electrical communication, between the first contact portion 726, the second contact portion 736, and the first fuse terminal 262. It will be understood that contact between the second discharge connector 704 and the second fuse terminal 264 may be achieved in a similar way. The window 253 may allow for visual confirmation of the connection between the first discharge connector 702 and the first fuse terminal 262 and between the second discharge connector 704 and the second fuse terminal 264.

Figure 19:
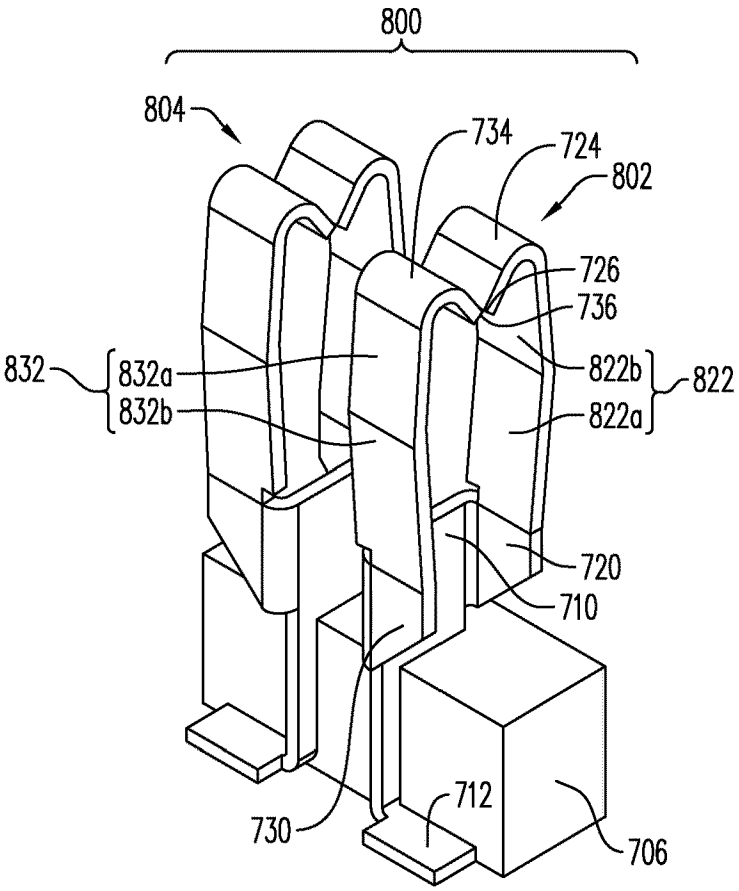
FIG. 19 is a perspective view of a fuse connector assembly according to an exemplary embodiment.
Figure 18:
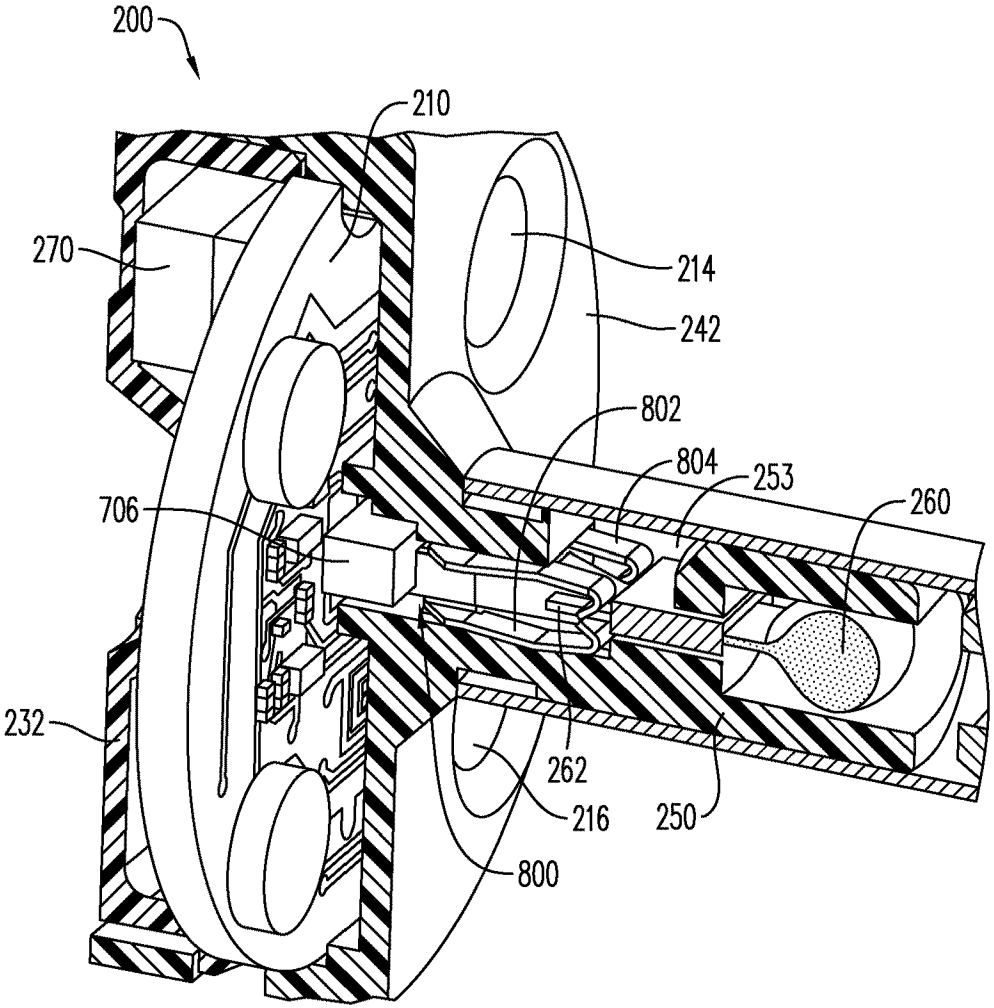
FIG. 18 is a cutaway perspective view of an initiator head according to an exemplary embodiment.

FIGS. 18-19 show an exemplary embodiment in which the circuit board 210 is in electrical communication with the fuse 260 via a fuse connector assembly 800. The fuse connector assembly 800 is similar in many aspects to the fuse connector assembly 700; similar structures will be indicated with the same reference numerals, and detailed descriptions of these similar structures will be omitted. In the fuse connector assembly 800, the first arm portion 822 may include a first arm part 822*a* extending from the first base portion 720 and a second arm part 822*b* extending from the first arm part 822*a*. The second arm portion 832 may include a third arm part 832*a* extending from the first base portion 730 and a fourth arm part 832*b* extending from the first arm part 832*a*. Each of the first art part 822*a* and the third arm part 832*a* may be bent or inclined in a direction away from each other. Each of the second arm part 822*b* and the fourth arm part 832*b* may be bent or inclined in a direction toward each other.

FIGS. 2-7 shows an exemplary embodiment of an initiator 100. The initiator 100 may include an initiator head 200 and an initiator shell 300. The initiator head 200 may be similar in structure and function as described in detail above. The initiator shell 300 may be coaxial with the initiator head 200. In an exemplary embodiment, a head dimension X1 of the head 200 in a first direction perpendicular to the axial direction 302 may be larger than a shell dimension X2 in the first direction. According to an aspect, the initiator may be configured as an ignitor or a detonator, depending on the needs of the application.

In an exemplary embodiment, the initiator shell 300 may include a shell wall 310 and a shell crimp 312 crimped around the stem 250. The shell wall 310 may extend in the axial direction 302 and may be formed of a deep-drawn metal. Non-limiting examples of the metal used for the shell wall 310 may include aluminum, copper, steel, tin, or brass. Plastics may also be used a material for the shell wall 310. The shell wall 310 may define a shell interior 320. A primary explosive 322 may be provided within the shell interior 320. In an exemplary embodiment, the circuit board 210 may be configured to activate the primary explosive 322, and in some embodiments the primary explosive 322 and the secondary explosive 324, in response to a control signal received at the line-in terminal 212. For example, the primary explosive 322 may be arranged such that the fuse 260 is within an operable distance of the primary explosive 322. Being within an operable distance means that the fuse 260 is provided close enough to the primary explosive 322 that the primary explosive 322 is ignited and/or detonated when the fuse 260 is activated. In other words, by activating the fuse 260 in response to a control signal, the circuit board 210 may activate the primary explosive 322.

The secondary explosive 324 may abut the primary explosive 322 and seal the primary explosive 322 within a non-mass explosive (NME) body 330. The primary explosive 322 and the secondary explosive 324 may have a total thickness of about 3 mm to about 30 mm in an exemplary embodiment. Alternatively, the total thickness may be about 3 mm to about 10 mm. The secondary explosive 324 may be configured as a layer of an explosive material. According to an exemplary embodiment, the primary explosive 322 may include at least one of lead azide, silver azide, lead styphnate, tetracene, nitrocellulose, BAX, and a lead azide free primary explosive as described in USPGP 2019/0256438, herein incorporated by reference.

Each of the primary explosive 322 and the secondary explosive 324 may have a safe temperature rating of above 150° C. (with the exception of PETN, which has a rating of approximately 120° C.). The secondary explosive 324 may include a material that is less sensitive to initiation, as compared to the primary explosive 322. The secondary explosive 324 may include at least one of PETN, RDX, HMX, HNS and PYX. In an embodiment, the secondary explosive 324 may be less sensitive to initiation than PETN.

The primary explosive 322 and the secondary explosive 324 may be provided within the NME body 330. The NME body 330 may help to avoid an unintentional initiation of the primary explosive 322 or the main load explosive 332 by an external mechanical force. The NME body 330 may be composed of an electrically conductive, electrically dissipative or electrostatic discharge (ESD) safe synthetic material. According to an exemplary embodiment, the non-mass-explosive body 330 may be formed of a metal, such as cast-iron, zinc, machinable steel or aluminum. Alternatively, the NME body 330 may be formed from a plastic material. While the NME body 330 may be made using various processes, the selected process utilized for making the NME body 330 is based, at least in part, by the type of material from which it is made. For instance, when the NME body 330 is made from a plastic material, the selected process may include an injection molding process. When the NME body 330 is made from a metallic material, the NME body 330 may be formed using any conventional CNC machining or metal casting processes.

The initiator shell 300 may further include a main load explosive 332 provided adjacent the primary explosive 322, and in embodiment including a secondary explosive 324, adjacent the secondary explosive 324. The main load explosive 332 includes compressed secondary explosive materials. According to an aspect, the main load explosive 332 may include one or more of cyclotrimethylenetrinitramine (RDX), octogen/cyclotetramethylenetetranitramine (HMX), hexanitrostilbene (HNS), pentaerythritol tetranitrate (PETN), 2,6-Bis(picrylamino)-3,5-dinitropyridine (PYX), and 1,3,5-triaminio-2,4,6-trinitobenzene (TATB). The type of explosive material used may be based at least in part on the operational conditions in the wellbore and the temperature downhole to which the explosive may be exposed.

Figure 11:
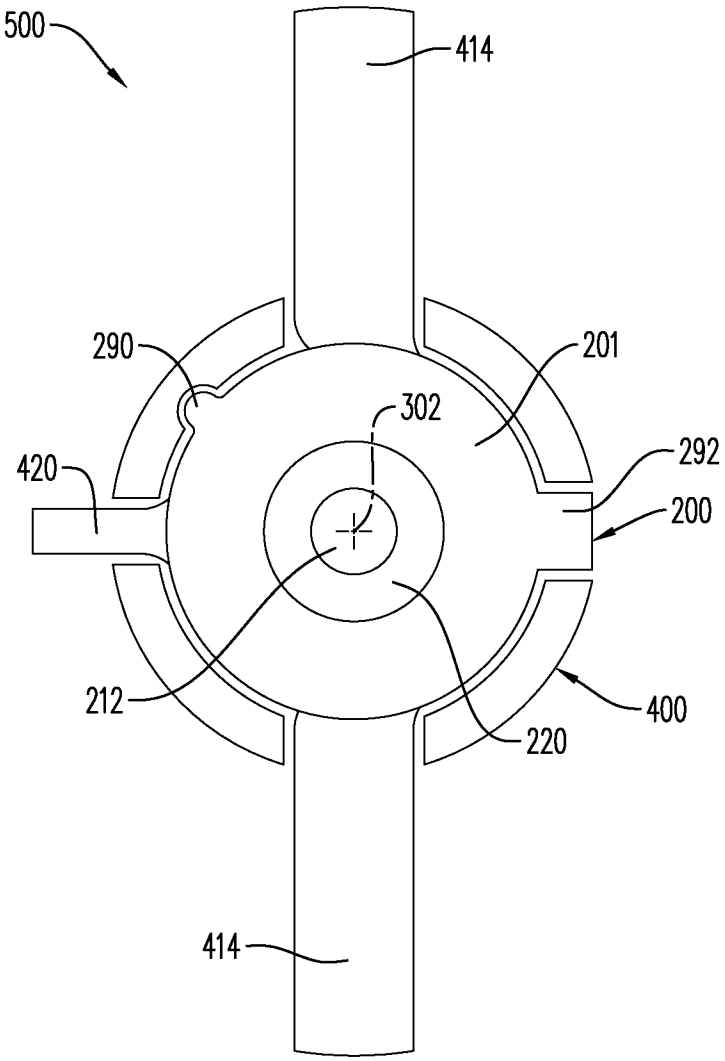
FIG. 11 is a plan view of an initiator head and initiator holder according to an exemplary embodiment.
Figure 13:
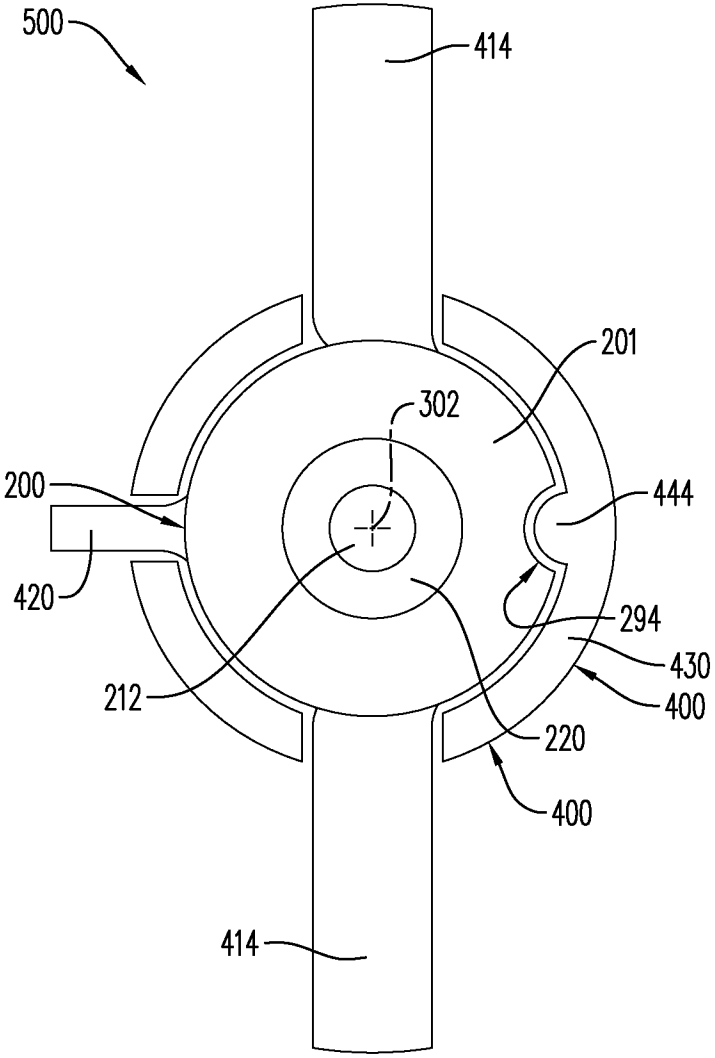
FIG. 13 is a plan view of an initiator head an initiator holder according to an exemplary embodiment.
Figure 12:
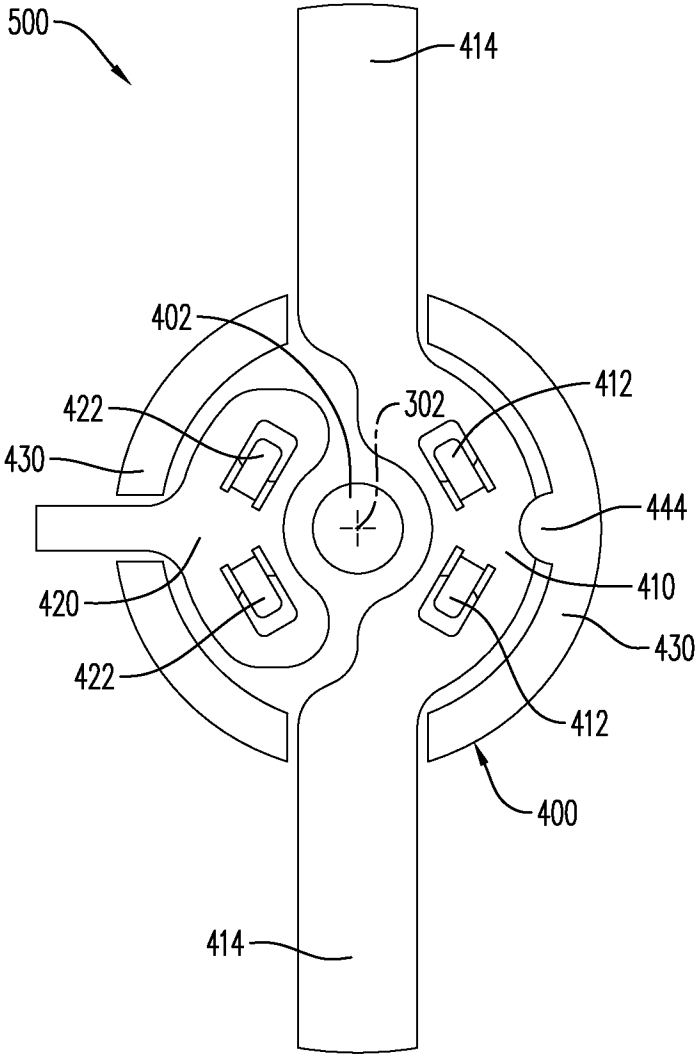
FIG. 12 is a plan view of an initiator holder and terminals according to an exemplary embodiment.

In an exemplary embodiment shown in FIGS. 11-13, an exterior shape of the housing 201 may be rotationally asymmetric with respect to the axial direction 302. In other words, when looking along the axial direction 302, a periphery of the housing 201 may be shaped such that an orientation of the housing 201 is unique for each angle around the axial direction. For example, FIG. 11 shows that a key protrusion 290 or a key protrusion 292 may be formed on a periphery of the housing 201, and FIG. 13 shows that a key recess 294 may be formed on a periphery of the housing 201. As is clear from FIG. 11 and FIG. 13, there are no possible rotations of the housing 201 where the housing 201 has a matching profile. In other words, an exterior profile of housing 201 is unique for each possible rotation angle. It will be understood that the size, shape, and/or number of key protrusions and/or key recesses is not limited to what is shown in FIG. 11 and FIG. 13, as long as they create a rotational asymmetry in the shape of housing 201. Additionally, key protrusions and key recesses may be combined together on a single housing 201.

FIGS. 8-13 illustrate an exemplary embodiments of an initiator system 500. The initiator system 500 may include an initiator holder 400 (see FIGS. 10-13) and an initiator 100 received within the initiator holder 400.

Figure 9:
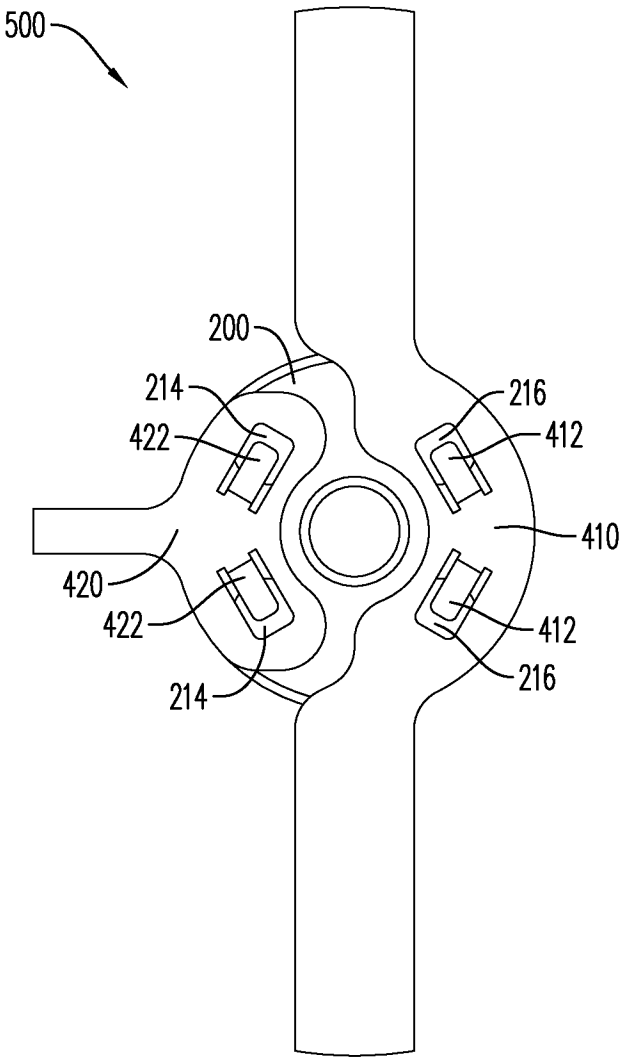
FIG. 9 is a bottom up view of an initiator engaged with terminals according to an exemplary embodiment.
Figure 8:
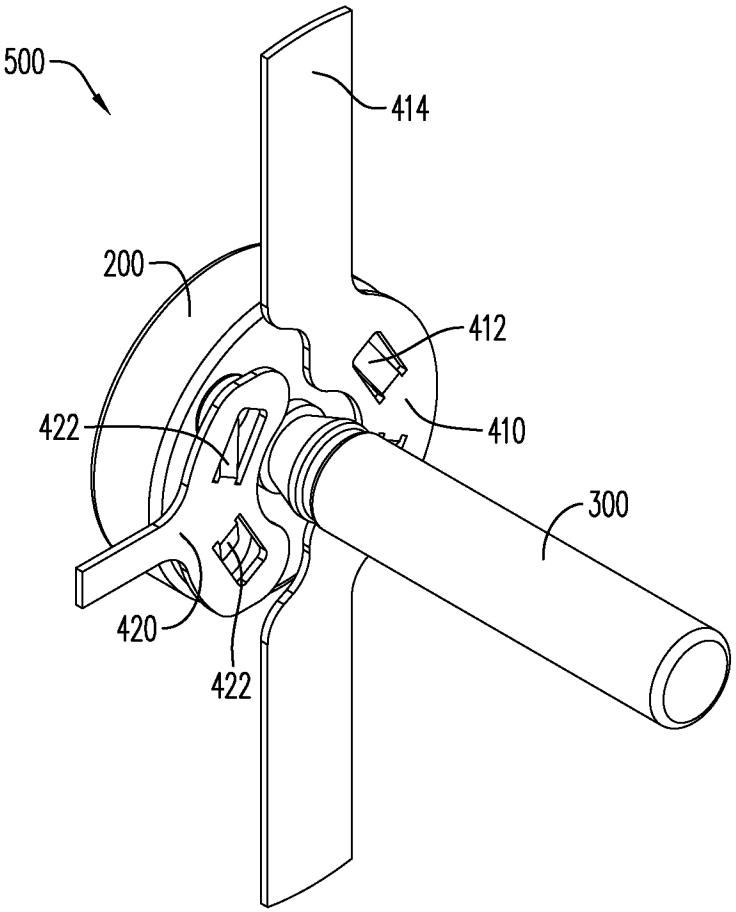
FIG. 8 is a perspective view of an initiator engaged with terminals according to an exemplary embodiment.
Figure 10:
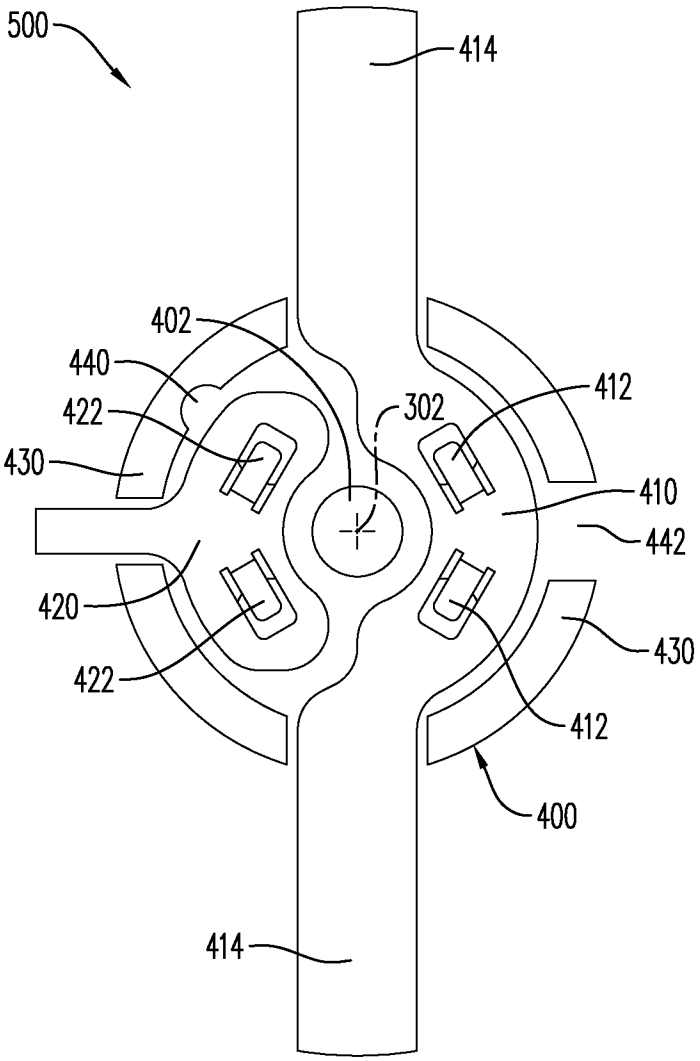
FIG. 10 is a plan view of an initiator holder and terminals according to an exemplary embodiment.

As seen in FIGS. 8-10, an exemplary embodiment of the initiator holder 400 may include a holder ground terminal 410. The holder ground terminal 410 may include a holder ground contact 412. In an exemplary embodiment shown in FIGS. 8-9, the holder ground contact 412 may be punched from the material of the holder ground terminal 410 and then bent to a side of the holder ground terminal 410. This may help to impart a spring-loaded action to the holder ground contact 412 and bias the holder ground contact 412 in a direction toward the initiator head 200, thereby helping to ensure a more secure electrical contact between the ground terminal 216 and the holder ground contact 412. In other words, when the initiator 100 is positioned within the initiator holder 400, the holder ground contact 412 may be in electrical communication with the ground terminal 216 (see FIG. 9) via contact.

FIGS. 8-10, and FIG. 12 show that, in an exemplary embodiment of the holder ground terminal 410, the holder ground contact 412 may be one of a plurality of holder ground contacts 412. As seen in FIG. 9, if the initiator head 200 includes a plurality of ground terminals 216, then the plurality of holder ground contacts 412 provided a layer of redundancy for establishing a connection to ground. For example, even of one pair the ground terminals 216 and the holder ground contacts 412 fails to establish a secure electrical connection, a second pair of the ground terminals 216 and the holder ground contacts 412 may form a secure electrical connection.

As further seen in FIGS. 10-13, the initiator holder 400 may further include a holder ground bar 414 extending from the holder ground terminal 410. The holder ground bar 414 may contact a ground when the initiator holder 400 is received within a perforating gun. In other words, the holder ground terminal 410 may be in electrical communication with ground, for example through the holder ground bar 414.

As further seen in the exemplary embodiment of FIG. 10, the initiator holder 400 may include a through-wire terminal 420. The through-wire terminal 420 may include a through-wire contact 422. In an exemplary embodiment shown in FIGS. 8-9, the through wire contact 422 may be punched from the material of the through-wire terminal 420 and then bent to a side of the through-wire terminal 420. This may help to impart a spring-loaded action to the through-wire contact 422 and bias the through-wire contact 422 in a direction toward the initiator head 200, thereby helping to ensure a more secure electrical contact between the through-wire terminal 214 and the through-wire contact 414. In other words, when the initiator 100 is positioned within the initiator holder 400, the through-wire contact 422 may be in electrical communication with the through-wire terminal 214 via contact.

FIGS. 8-9, FIG. 10, and FIG. 12 show that, in an exemplary embodiment of the through-wire terminal 420, the through-wire contact 422 may be one of a plurality of through-wire contacts 422. As seen in FIG. 9, if the initiator head 200 includes a plurality of through-wire terminals 214, then the plurality of through-wire contacts 422 provided a layer of redundancy for establishing an electrical connection. For example, even of one pair the through-wire terminals 214 and the through-wire contacts 422 fails to establish a secure electrical connection, a second pair of the through-wire terminals 214 and the through-wire contacts 412 may form a secure electrical connection.

FIGS. 10-13 show exemplary embodiments of an initiator system 500 comprising a key system configured to ensure a correct alignment between the initiator 100 and the initiator holder 400. For example, when an initiator 100 is received into holder hole 402, the initiator 100 may rotate around the axial direction 302. This could create a misalignment between the through-line terminal(s) 214 and the ground terminal(s) 216 of the initiator head 200 and the through-line contact(s) 422 and holder ground contact(s) 412 of the holder 400. Accordingly, a key system may be configured to rotationally fix the initiator head 200 relative to the holder 400, thereby helping to ensure a correct alignment between the initiator 100 and the initiator 400. In this context, a correct alignment may be an alignment in which the through-line terminal(s) 214 and the ground terminal(s) 216 of the initiator head 200 are correspondingly aligned with the through-line contact(s) 422 and holder ground contact(s) 412 of the holder 400.

FIGS. 10-11 show an exemplary embodiment in which recesses 440, 442 may be formed in an outer peripheral wall 430 of the holder 400. For example, a first holder recess 440 may be formed partially through the outer peripheral wall 430. Alternatively or additionally, a second holder recess 442 may be formed through the entire thickness of the outer peripheral wall 430. As seen in FIG. 11, an exemplary embodiment of the housing 201 of the initiator head 200 may include a first key protrusion 290 formed on an outer periphery of housing 201. The first key protrusion 290 may be shaped and sized to fit within the first holder recess 440. Alternatively or additionally, a second key protrusion 292 may be formed on an outer periphery of the housing 201. The second key protrusion 292 may be shaped and sized to fit within the second holder recess 442.

FIGS. 12-13 show an exemplary embodiment in which protrusions may be formed in the outer peripheral wall 430 of the holder 400. For example, a holder protrusion 444 may extend radially inwardly from the outer peripheral wall 430. As seen in FIG. 13, an exemplary embodiment of the housing 201 of the initiator head 200 may include a housing recess 294 corresponding to the holder protrusion 444.

It will be understood from the exemplary embodiments shown in FIGS. 10-13 that the number, size, and shape of recesses and protrusions may be varied to achieve the same effect, as long as the recesses and their corresponding protrusions are rotationally asymmetric around the longitudinal axis. For example, a single recess and a single protrusion may be sufficient to achieve rotational asymmetry. Alternatively, a plurality of recesses of corresponding protrusions may be used. Further, it will be understood that recesses and protrusions may be mixed on a single piece. For example, an exemplary embodiment of the housing 201 may include both a protrusion and a recess, corresponding to a complementary recess and protrusion on the initiator holder 400.

Figure 20:
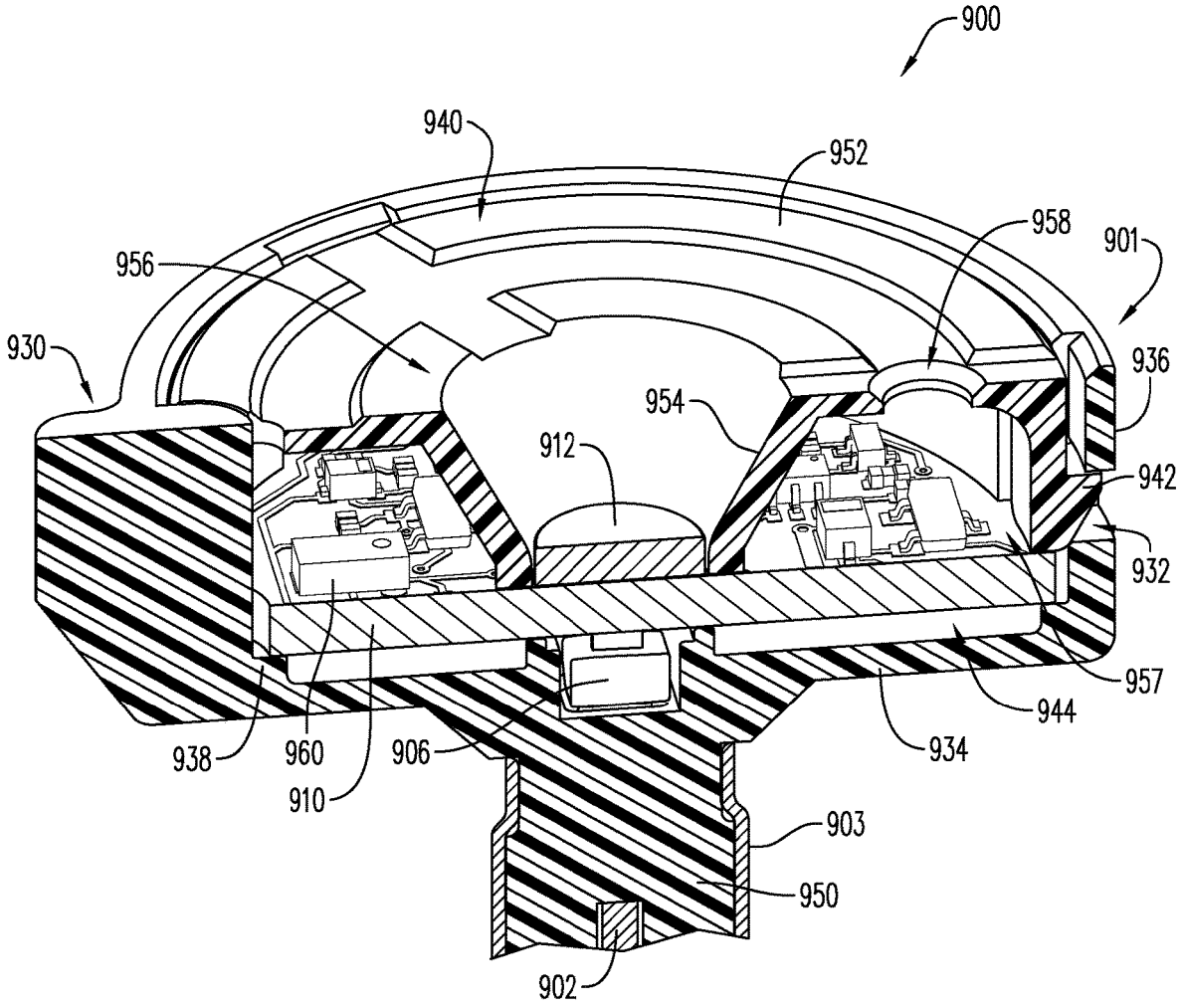
FIG. 20 is a cutaway perspective view of an initiator head according to an exemplary embodiment.

FIG. 20 shows an exemplary embodiment of an initiator head 900, similar to the initiator head 200 described with reference to FIGS. 1-7. For purposes of brevity, only selected features of the initiator head 900 that differ from the initiator head 200 of FIGS. 1-7 will be described in detail. The initiator head 900 generally includes a housing 901, a circuit board 910 supported in the housing 901, a line-in terminal 912, a line-out terminal (not explicitly shown), a ground terminal (not explicitly shown), a stem 950, a fuse (not explicitly shown), a mounting block 906, and a discharge connector 902 extending through the mounting block 906 and in electrical communication with the circuit board 910. The mounting block 906 may be formed of an insulating material and may facilitate connection and/or fastening of the fuse discharge connector to the circuit board 210.

The housing 901 may be formed of an insulating material, and may be formed by molding, 3D-printing, additive manufacturing, subtractive manufacturing, or any other suitable method. For example, in an exemplary embodiment, the housing 901 may be formed of a non-conductive plastic material such as polyamide. The housing 901 may be a housing assembly that includes a first housing piece 930 and a second housing piece 940 engaged together using any suitable fastening engagement. For example, the second housing piece 940 may include a projection 942 configured to form an interference fit with a slot 932 defined in the first housing piece 930. Alternatively, the first and second housing pieces 930, 940 may be an integral or monolithic piece molded or additively manufactured around the circuit board 910.

The first housing piece 930 includes a base 934 and a cylindrical wall 936 extending perpendicularly from an outer periphery of the base 934. As such, the first housing piece 930 may have a cup shape. In an exemplary aspect, the base 934 may be annular. In aspects, the base 934 and the wall 936 may assume other suitable shapes, such as, for example, a square, a triangle, a rotationally asymmetric shape, or the like. The base 934 may have an annular ledge 938 on which the circuit board 910 is supported to define an axial space 944 between the circuit board 910 and a bottom surface of the base 934.

The stem 950 of the initiator head 900 may extend perpendicularly from a central location of the base 934 and may be monolithically formed with the base 934 such that the first housing piece 930 and the stem 950 are a single structure. In aspects, the stem 950 may be fastened to the base 934 via any suitable fastening engagement, such as, for example, adhesives, heat treatment, an interference fit, or the like. The stem 950 is received in an initiator shell 903, similar to the initiator shell 300.

The second housing piece 940 may include a plate 952 and a sloped wall 954 sloping or tapering from the plate 952 in an axial direction toward the circuit board 910. The plate 952 defines a plane that is parallel with and axially spaced from a plane defined by the base 934. The plate 952 may be flush with an inner-facing surface of the wall 936 of the first housing piece 930, such that the first housing piece 930 and the second housing piece 940, when coupled, collectively define an enclosure or interior chamber 957 of the housing 901. The plate 952 may have a substantially circular periphery and a substantially circular center hole 956. Alternatively, in other aspects, the plate 952 may have a rotationally asymmetric periphery. The center hole 956 may be structured to expose the line-in terminal 912 to an exterior of the housing 901.

The second housing piece 940 further defines a fill hole 958 through the plate 952 at a location between the center hole 956 and an outer periphery of the plate 952. In aspects, the fill hole 958 may be formed in any suitable location of the second housing piece 940, such as, for example, in the sloped wall 957. In other aspects, the fill hole 958 may be provided in the wall 936 of the first housing piece 930. The fill hole 958 provides for fluid communication between an exterior of the housing 901 and the interior chamber 957 of the housing 901. As such, the fill hole 958 may be used to inject an insulating material (not explicitly shown), such as, for example, silicone or epoxy, into the interior chamber 957 to cover a top surface of the circuit board 910 (including electronics 960) and fill the interior chamber 957. In aspects, the fill hole 958 may be any suitable shape, such as, for example, round, triangular, square, or the like.

Figure 21:
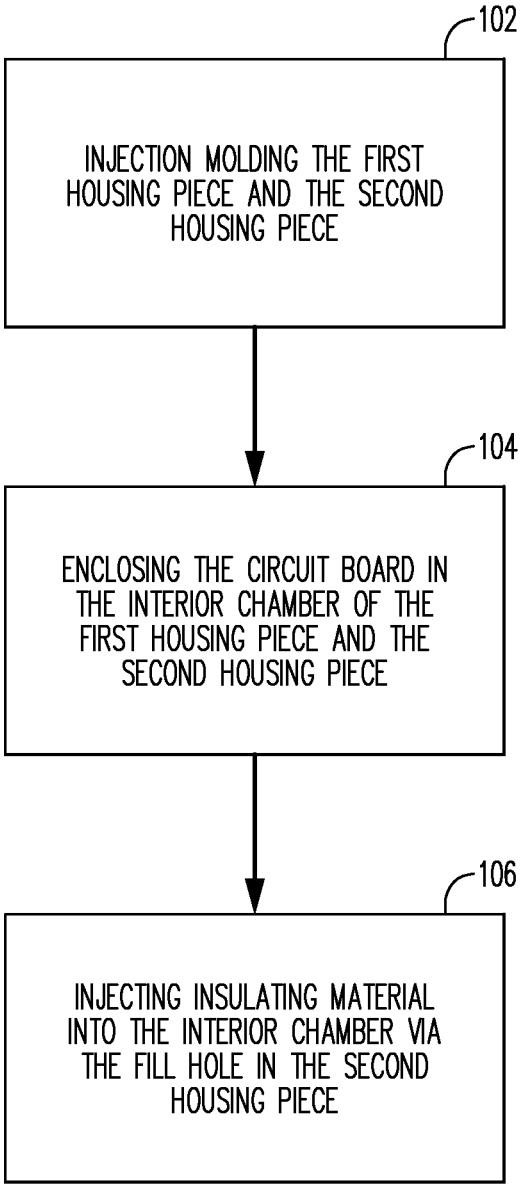
FIG. 21 is a flow chart illustrating an exemplary method of fabricating the initiator head of FIG. 20.
Figure 22:
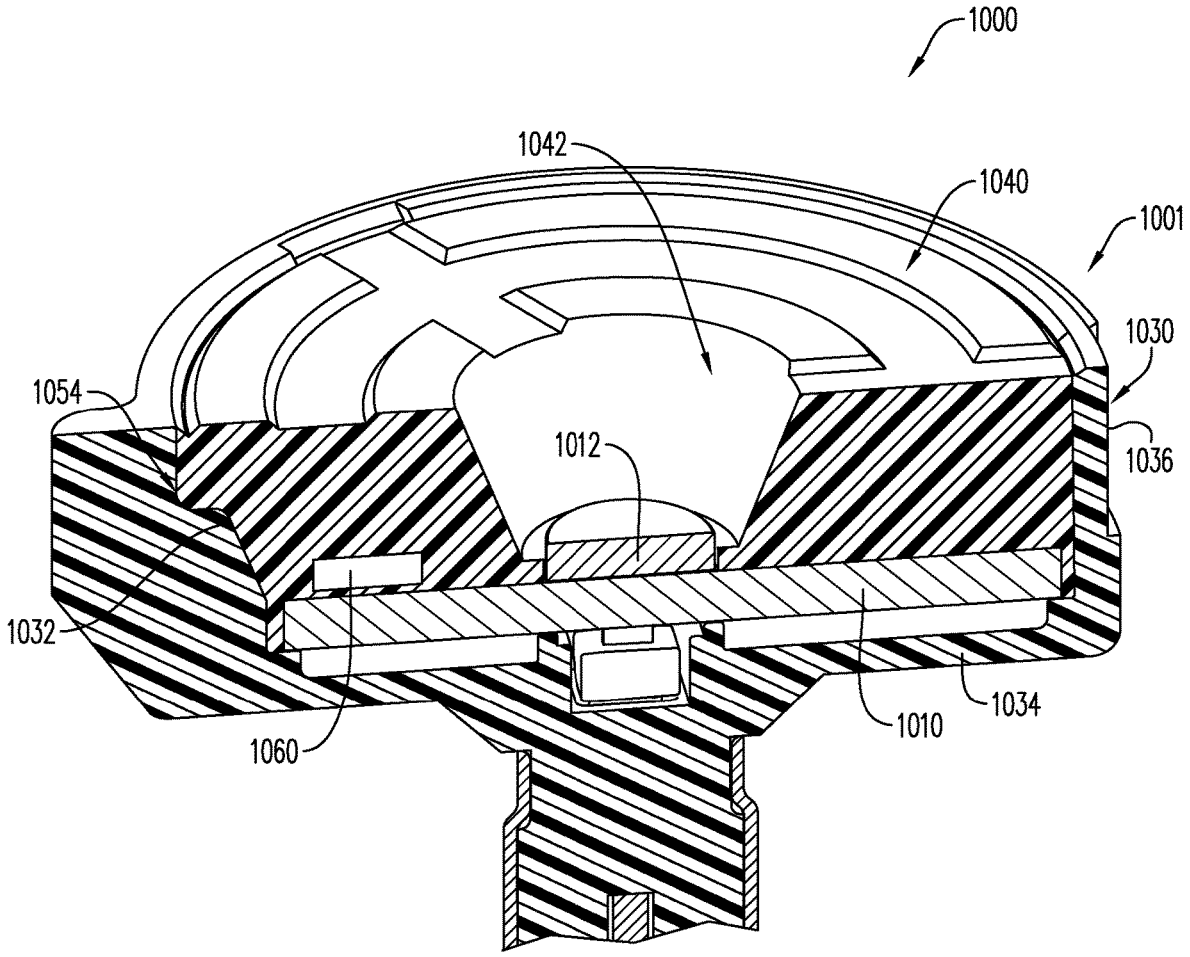
FIG. 22 is a cutaway perspective view of an initiator head according to an exemplary embodiment.

During manufacture of the initiator head 900, in step 102 of the flow chart shown in FIG. 21, the housing 901 of the initiator head 900 may be fabricated by injection molding the first and second housing pieces 930, 940. In step 104, the circuit board 910 may be positioned within the first housing piece 930, and the first and second housing pieces 930, 940 may be coupled to one another to enclose the circuit board 910 in the interior chamber 957 of the housing 901. In step 106, with the first and second housing pieces 930, 940 coupled to one another, an insulating material (e.g., silicone or epoxy) is injected into the interior chamber 957 of the housing 901 via the fill hole 957 defined in the plate 952 of the second housing piece 940. In aspects, the insulating material may completely or only partially fill the interior chamber 957. In aspects, the insulating material may also be used to fill the fill hole 958. With the interior chamber 957 filled with the insulating material, the electronic components 960 of the circuit board 910 are rendered more resistant to any physical shock experienced by the initiator head 900.

In another aspect, the insulating material may be injected into the first housing piece 930 to cover the circuit board 910 and fill the chamber 945 before coupling the second housing piece 940 to the first housing piece 930.

FIG. 21 shows an exemplary embodiment of an initiator head 1000, similar to the initiator head 900 described with reference to FIG. 20. For purposes of brevity, only selected features of the initiator head 1000 that differ from the initiator head 900 of FIG. 20 will be described in detail. The initiator head 1000 generally includes a housing 1001 and a circuit board 1010 supported in the housing 1001.

The housing 1001 may be formed of an insulating material, and may be formed by molding, 3D-printing, additive manufacturing, subtractive manufacturing, or any other suitable method. For example, in an exemplary embodiment, the housing 1001 may be formed of a non-conductive plastic material such as polyamide. The housing 1001 may be a housing assembly that includes an outer or first housing piece 1030 and an inner or second housing piece 1040 engaged together using any suitable fastening engagement. For example, the second housing piece 1040 may be press fit into a chamber 1054 defined in the first housing piece 1030. Alternatively, the first housing piece 1030 and the second housing piece 1040 may be an integral or monolithic piece molded or additively manufactured around the circuit board 1010.

The first housing piece 1030 includes an annular base 1034 and a cylindrical wall 1036 extending perpendicularly from an outer periphery of the base 1034. The second housing piece 1040 may be a unitary body assuming a disc shape with a tapered central channel 1042 defined therethrough. The second housing piece 1040 may be injection molded into the interior chamber 1054 of the first housing piece 1030 to embed electronics 1060 of the circuit board 1010 and cover a top surface of the circuit board 1010 without covering a line-in terminal 1012 of the initiator head 1000. In this way, the electronic components 1060 of the circuit board 1010 are rendered more resistant to any physical shock experienced by the initiator head 1000. The second housing piece 1040 may substantially fill the chamber 1054 of the first housing piece 1030. In other aspects, the second housing piece 1040 may only partially fill the chamber 1054 of the first housing piece 1030. The second housing piece 1040 is fabricated from an insulating material having a definite shape dimensioned to fill the chamber 1054 and conform to an inner peripheral wall 1032 of the first housing piece 1030 and a top surface of the circuit board 1010.

Figure 23:
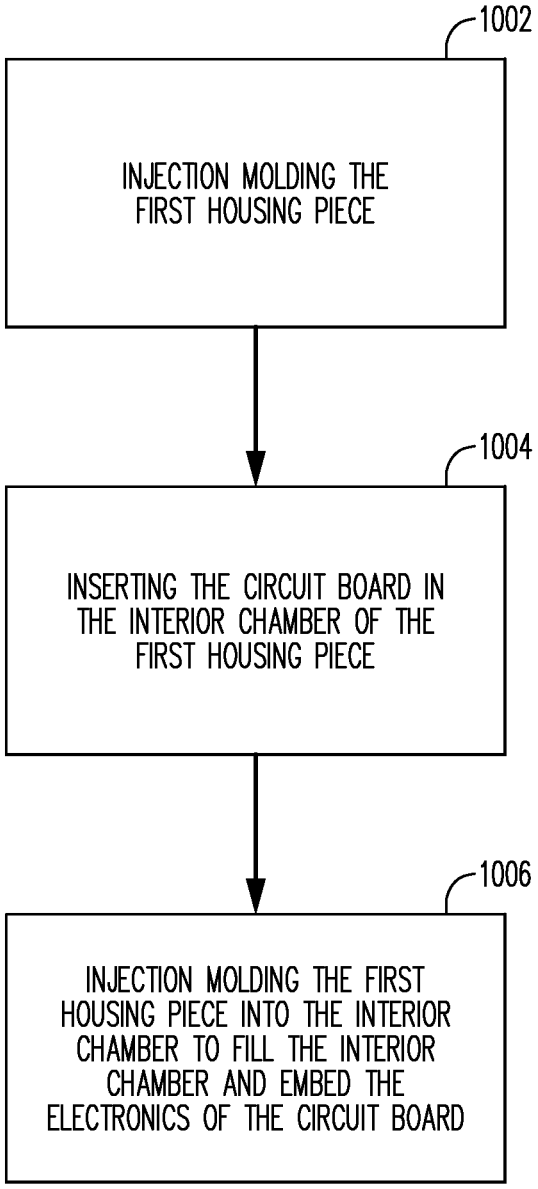
FIG. 23 is a flow chart illustrating an exemplary method of fabricating the initiator head of FIG. 22.

During manufacture of the initiator head 1000, in step 1002 of the flow chart shown in FIG. 23, the first housing piece 1040 is formed with the interior chamber 1054. In step 1004, the circuit board 1010 is inserted into the interior chamber 1054 of the first housing piece 1040. In step 1006, the second housing piece 1040 may be injection molded into the interior chamber 1054 of the first housing piece 1030 to fill the interior chamber 1054 and embed the electronics 1060 of the printed circuit board 1010.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine," "calculate," and "compute," and variations thereof, as used herein, are used interchangeably and include any type of methodology, process, mathematical operation or technique.

As used herein, the terms parallel and perpendicular are understood to include relative configurations that are substantially parallel and substantially perpendicular up to about + or −10 degrees from true parallel and true perpendicular.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A method of manufacturing an initiator head, the method comprising:

injection molding a first housing piece that defines an interior chamber, a circuit board being positioned within the interior chamber;

coupling a second housing piece to the first housing piece to cover the interior chamber; and filling the interior chamber with an insulating material thereby covering electronics of the circuit board with the insulating material;

wherein the second housing piece is coupled to the first housing piece before the interior chamber is filled with the insulating material; and filling the interior chamber comprises injecting the insulating material into the interior chamber via a hole defined through the second housing piece.

2. The method according to claim 1, wherein the insulating material is a second housing piece having a definite shape, and filling the interior chamber includes press fitting the second housing piece into the interior chamber.

3. The method according to claim 1, wherein the insulating material is a second housing piece, and filling the interior chamber includes injection molding the second housing piece into the interior chamber.

* * * * *